US005669815A

United States Patent [19]

Cakebread

[11] Patent Number: 5,669,815

[45] Date of Patent: Sep. 23, 1997

[54] BAROMETRIC DAMPER WITH MAGNETIC LATCH

[75] Inventor: Kenneth D. Cakebread, Florence, Ala.

[73] Assignee: Martin Industries, Inc., Florence, Ala.

[21] Appl. No.: 639,210

[22] Filed: Apr. 26, 1996

[51] Int. Cl.[6] ..... F24F 11/04

[52] U.S. Cl. ..... 454/255; 251/82; 454/259

[58] Field of Search ..... 454/238, 255, 454/254, 273, 360; 251/65, 82

[56] References Cited

U.S. PATENT DOCUMENTS

| | | | |
|---|---|---|---|
| 426,628 | 4/1890 | Smith | 454/255 X |
| 1,623,286 | 4/1927 | Strahan | 454/259 |
| 2,504,006 | 4/1950 | Davis | 251/82 |
| 4,498,624 | 2/1985 | Kogut | 454/255 X |
| 4,543,941 | 10/1985 | Newell | 454/359 X |

FOREIGN PATENT DOCUMENTS

| | | | |
|---|---|---|---|
| 797109 | 4/1936 | France | 454/259 |
| 566043 | 1/1957 | Italy | 251/82 |

*Primary Examiner*—Harold Joyce
*Attorney, Agent, or Firm*—Shook, Hardy & Bacon L.L.P.

[57] ABSTRACT

A barometric damper has a housing which is adapted to be coupled with a structure. The housing has an opening that allows spatial communication between the interior and the exterior of the structure. The damper also has a damper blade. The damper blade is movably coupled with the housing. The blade has an open position where the blade accommodates air passage through the opening and a closed position where the flow of air through the opening is substantially precluded. The damper also has a lever that is movably coupled with the housing. The lever has an attaching means that is used to attach the lever to the blade when desired. The lever is movable between a first position where the lever accommodates free movement of the blade in response to barometric pressure changes on opposite sides of the blade, and a second position where the lever maintains the attaching means against the blade, thus holding the blade in its closed position.

18 Claims, 2 Drawing Sheets

BAROMETRIC DAMPER WITH MAGNETIC LATCH

BACKGROUND OF THE INVENTION

The present invention relates to barometric dampers for use in either residential or commercial buildings.

Barometric dampers are being used with increasing frequency to provide a proper air flow into a building and to equalize the pressure inside a building with the pressure outside a building. Barometric dampers are advantageously used in any building in which a negative pressure can exist.

Barometric dampers normally consist of a device which communicates with both the interior and the exterior of a building. The device will normally have a damper blade. The damper blade covers an opening in the device when the blade is in a closed position. When the pressure outside is greater than the pressure inside, the blade will move to allow outside air to flow into the interior of the building. The barometric damper thus provides an air flow and also equalizes the pressure inside the building with the pressure outside the building.

It is sometimes desirable to maintain the damper blade in a closed position, such as when the outside temperature is extremely low and it is desired to prevent the cold air from entering the building. Conversely, when operating a combustion appliance, such as a furnace, or burning a fire in a fireplace, it is sometimes desirable to force the damper blade open and to maintain the damper blade in this open position. Maintaining the damper blade in an open position allows the combustion appliance to operate more efficiently by ensuring that a proper flow of fresh air is provided to the appliance. Barometric dampers have heretofore lacked a simple and reliable means that can be selectively operated to maintain the damper blade in a closed position or to force the damper blade into an open position.

Thus, a barometric damper is needed which can maintain the damper blade in a closed position when desired. Further, a barometric damper is needed that will simply, reliably and economically perform this function. A barometric damper is also needed which will also allow a user to maintain the damper blade in an open position when desired. Finally, a barometric damper is needed which will allow a user to select the desired operation of the damper blade.

SUMMARY OF THE INVENTION

It is a primary object of the present invention to provide a barometric damper so constructed that the damper blade can be maintained, when desired, in a closed position utilizing a simple, nonmechanical device.

A further object of this invention is to provide a barometric damper with a damper blade that can be maintained in an open position when so desired.

Another object of this invention is to provide a means for maintaining the damper blade of a barometric damper in a closed position that is simple and economical and that is at the same time reliable and relatively free from the need for any maintenance.

It is a still further object of the invention to provide a barometric damper with a damper blade that can be maintained in a closed position or an open position, and that can be placed in a position that allows the blade to open or close subject to the pressures inside and outside of the building.

According to the present invention, the foregoing and other objects are achieved by a barometric damper that has a housing which is adapted to be coupled with a structure.

The housing has an opening that allows spatial communication between the interior and the exterior of the structure. The barometric damper of the present invention also has a damper blade. The damper blade is movably coupled with the housing. The blade has an open position where the blade accommodates air passage through the opening, and a closed position where the flow of air through the opening is substantially precluded. The damper also has a lever that is movably coupled with the housing. The lever has an magnet that is used to attach the lever to the blade when desired. The lever is movable between at least two positions. One position accommodates free movement of the blade in response to barometric pressure changes on opposite sides of the blade. A second position of the lever maintains the magnet against the blade, thus holding the blade in its closed position.

Additional objects, advantages, and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENTS

Figure 1:
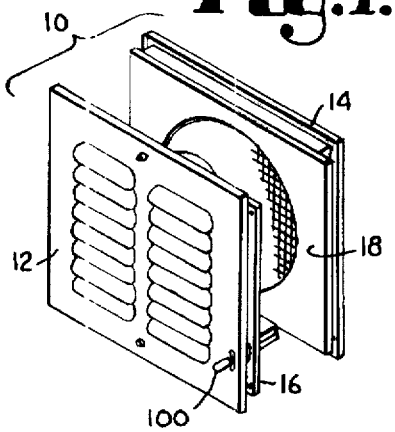
FIG. 1 is a front perspective view of a barometric damper assembly according to the present invention.
Figure 10:
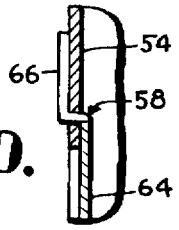
FIG. 10 is a partial side view of the damper housing taken along line 10—10 of FIG. 5.
Figure 3:
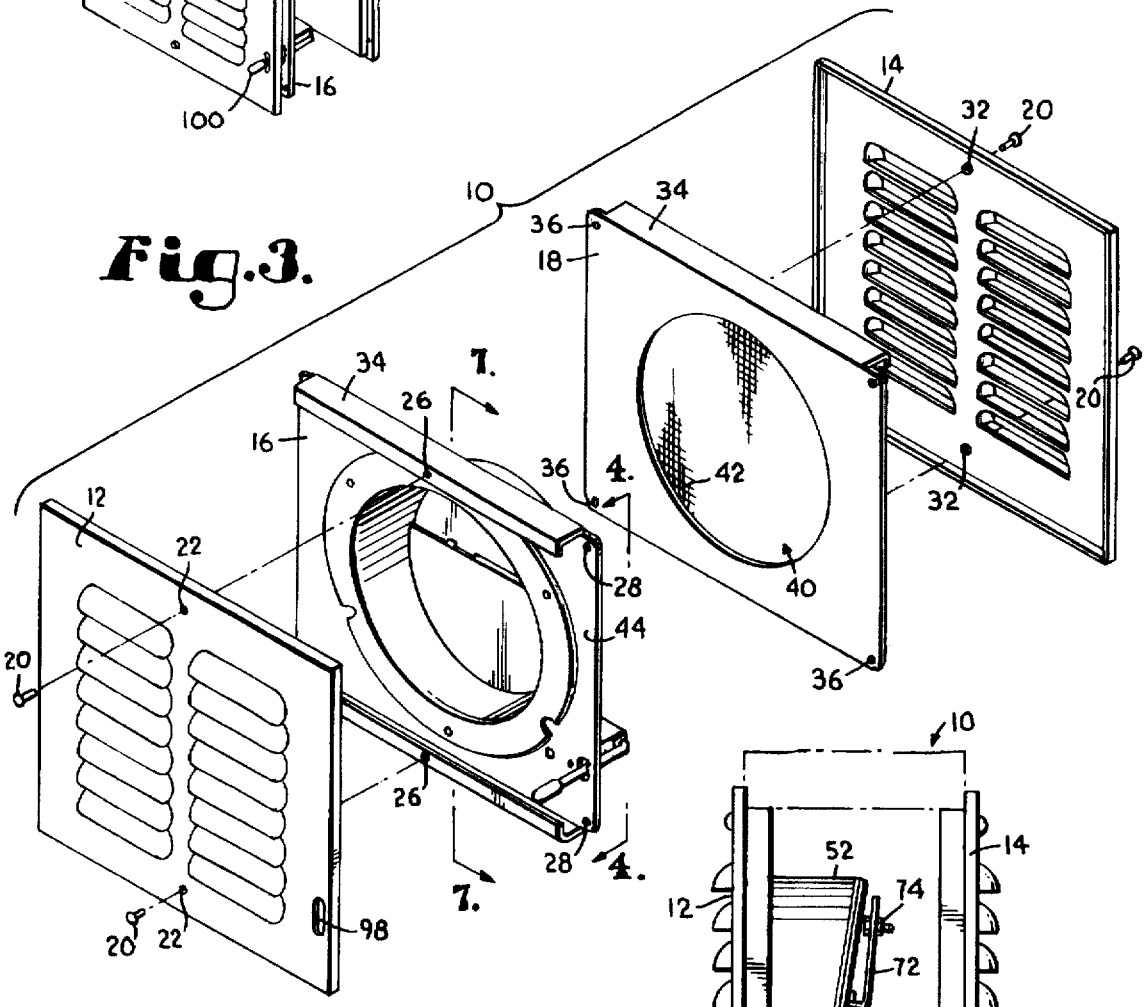
FIG. 3 is an exploded perspective view of the barometric damper assembly of FIG. 1.
Figure 2:
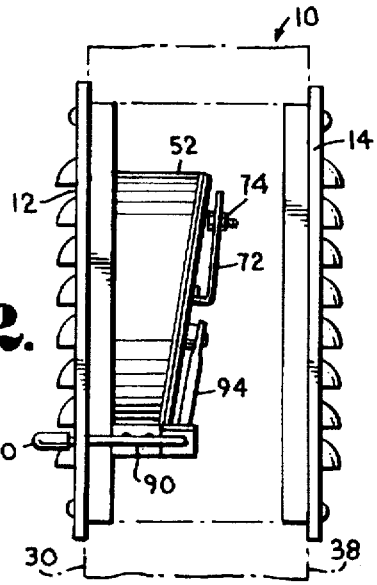
FIG. 2 is a side view of the barometric damper assembly of FIG. 1, with the damper blade shown in a closed position and the damper lever shown maintaining the blade in a closed position.
Figure 11:
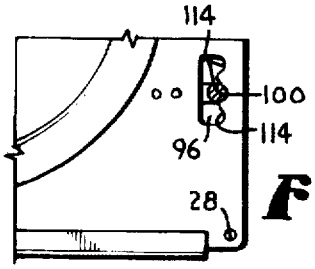
FIG. 11 is a partial front view of the damper housing taken along line 11—11 of FIG. 8.

With initial reference to FIGS. 1–3, a barometric damper assembly embodying the principles of this invention is broadly designated by the reference numeral 10. Damper assembly 10 has an inner grill 12 and an outer grill 14. Inner grill 12 is secured to a damper housing 16. Outer grill 14 is secured to back plate 18. Inner grill 12 is shown secured to housing 16 by screws 20, although any suitable attaching means may be used. Inner grill 12 has interior through holes 22. Housing 16 has spacers 24 formed thereon. Spacers 24 have threaded apertures 26 formed therethrough. Screws 20 are placed through interior through holes 22 and are threaded into apertures 26, thereby securing inner grill 12 and housing 16 together. Housing 16 has interior mounting holes 28. Mounting holes 28 allow housing 16 to be secured to an interior wall 30. Any suitable attaching means, such as screws or nails, may be used to attach housing 16 to wall 30.

Outer grill 14 is similarly secured to back plate 18. Outer grill 14 is secured to back plate 18 by screws 20, although any other suitable attaching means may be used. As best seen in FIG. 3, outer grill 14 has exterior mounting holes 32 formed therethrough. Back plate 18 has lips 34 formed thereon. Lips 34 have threaded apertures (not shown) formed therethrough that are similar to threaded apertures 26. Screws 20 are passed through exterior through holes 32 and are threaded into the threaded apertures on lips 34, thereby securing outer grill 14 to back plate 18. Back plate 18 has exterior mounting holes 36 formed therethrough. Mounting holes 36 allow back plate 18 to be secured to an exterior wall 38. Any suitable attaching means may be used to attach back plate 18 to wall 38, such as screws or nails.

Back plate 18 has a passage 40 therethrough. Passage 40 is shown as circular, but any number of shapes may be used. Passage 40 may be covered by a screen 42. Screen 42 is used to prevent foreign material, such as flying insects, from entering the interior of the building. Screen 42 may be secured to back plate 18 through any suitable means, such as an adhesive.

Figure 4:
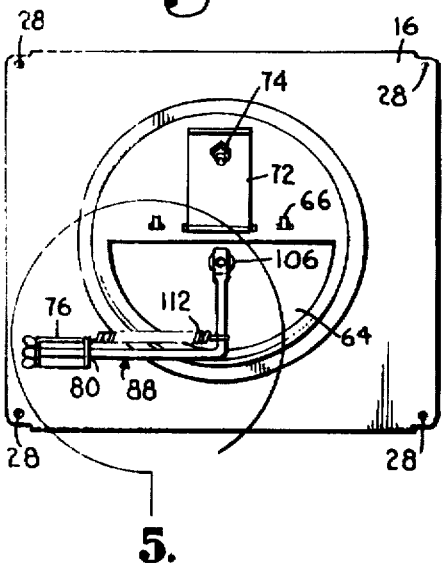
FIG. 4 is a rear view of the damper housing of the barometric damper assembly of FIG. 1 taken along line 4—4 of FIG. 3.
Figure 5:
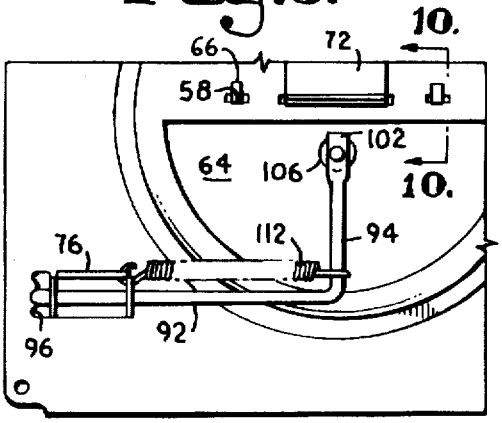
FIG. 5 is an enlarged rear view of the damper housing within the captured region (5) of FIG. 4.
Figure 6:
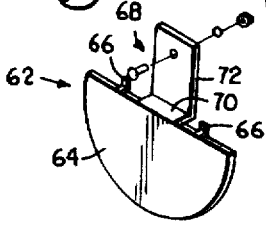
FIG. 6 is an exploded perspective view of the damper housing of FIG. 4.
Figure 6:
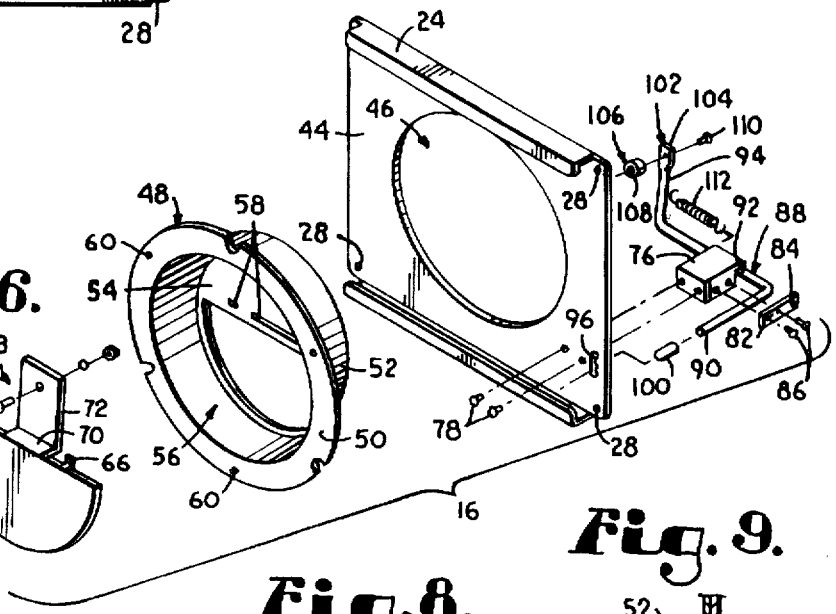

With reference to FIG. 3 and FIGS. 4–6, damper housing 16 will be further described. As best shown in FIG. 6, housing 16 has an inner wall plate 44. Inner wall plate 44 has a circular opening 46. Attached to wall plate 44 is a duct 48. Duct 48 has an annular mounting surface 50. Mounting surface 50 abuts wall plate 44, as is more fully discussed below. Extending perpendicularly from surface 50 is an annular wall 52. As best shown in FIG. 2, wall 52 extends further away from surface 50 at its uppermost point than at is lowermost point, thus sloping towards the interior of the building from top to bottom. Wall 52 terminates at a face 54. Face 54 is therefore held within the space defined by the interior and exterior walls. Face 54 is preferably formed integrally with surface 50 and wall 52. Therefore, face 54 also slopes toward the interior of the building from top to bottom. Face 54 has a mouth 56 formed therethrough. Mouth 56 is shown in the shape of a semi-circle, although it should be understood that any number of shapes would be operable and are therefore within the scope of this invention. Mouth 56 is the opening through which air will flow, as will be more fully described below. Face 54 also has formed therethrough slots 58. Slots 58 are used to secure a damper blade 62 to duct 48, as is more fully described below.

Duct 48 is secured to wall plate 44. Surface 50 has eyelets 60 formed therethrough. Surface 50 is shown equipped with three eyelets 60, spaced equally around surface 50. Screws may be passed through eyelets 60 and threaded into inner wall plate 44 to secure duct 48 to wall plate 44. Other means may be used to attach duct 48 to wall plate 44, such as rivets, or welding. Further, duct 48 may be formed integrally with inner wall plate 44.

Attached to duct 48 is damper blade 62. Blade 62 has a flap 64. Flap 64 is shaped similarly to mouth 56, and is shown in the shape of a semi-circle. Flap 64 is dimensioned to be larger than mouth 56, such that mouth 56 can be completely covered by flap 64. Extending from a top edge of flap 64 are tabs 66. Tabs 66 extend through slots 58 in face 54. Tabs 66 thus allow the bottom of flap 64 to swing upwardly away from face 54, while maintaining the top of flap 64 substantially against face 54.

Extending from the top edge of flap 64 is a balance 68. Balance 68 has a tongue 70 that extends through the largest and central slot 58. Tongue 70 thus extends balance 68 further towards the exterior of the building than duct 48. Balance 68 further has a projection 72 extending upwardly from tongue 70. Disposed on projection 72 is a weight 74. Weight 74 is shown as a nut, bolt and washer assembly, but any suitable weighting means could be used. Weight 74 may be varied to allow damper assembly 10 to operate at a wide range of pressure differentials. Further, projection 72 could be slotted in the vertical direction and the position of weight 74 could be varied along the length of the slot to change the center of gravity of balance 68. Such a slotted system could be used to allow damper assembly 10 to operate at a wide range of pressure differentials.

Attached to the exterior side of wall plate 44 is a bracket 76. Bracket 76 is shown in FIG. 6 as being attached to plate 44 with sheet metal screws 78. Bracket 76 extends towards the exterior of the building. Bracket 76 has formed therein a first lever retaining aperture 80, as best shown in FIGS. 4 and 7–9. Bracket 76 has attached thereto a rectangular extension 82. Rectangular extension 82 has formed therein a second lever retaining aperture 84. Extension 82 may be attached to bracket 76 by any suitable attaching means. As best shown in FIG. 6, rivets 86 may be used to attach extension 82 to bracket 76. Further, bracket 76 and extension 82 may be formed in one piece, thus eliminating the need for rivets 86.

Damper housing 16 further has a lever 88 attached thereto. Lever 88 is shown extending through wall plate 44, and through the first and second lever apertures of bracket 76 and extension 82. As best shown in FIG. 6, lever 88 has two bends which define three lever sections. First lever section 90 extends through wall plate 44. Wall plate 44 has a slotted lever opening 96 to allow first section 90 to pass therethrough. Further, as can best be seen in FIG. 3, inner grill 12 has an oblong slot 98. Slot 98 allows first section 90 to pass through inner grill 12 so that a portion of lever 88 is accessible from the interior of the building, the importance of which is more fully discussed below. Disposed on the end of first section 90 is an optional cover 100. Cover 100 is attached to lever 88 via a friction fit, and may be further secured in place with any suitable attaching means, such as an adhesive. Cover 100 acts to protect users of barometric damper assembly 10 from any burrs or sharp edges that may be present on the end of lever 88. Lever 88 has a second section 92 that extends perpendicularly from first section 90. Second section 92 extends through the retaining apertures on bracket 76 and extension 82. Lever 88 is allowed to slide horizontally and to rotate within the lever retaining apertures of bracket 76 and extension 82. Extending perpendicularly upward from second section 92 is third lever section 94. Third lever section 94 has a flattened terminal end 102, as best seen in FIGS. 5 and 6. Flattened end 102 has a bore 104 extending therethrough. Attached to third lever section 94 is a magnet 106. Magnet 106 may be attached to lever section 94 with any suitable attaching means. Magnet 106 is shown having a centrally disposed pilot hole 108. Rivet 110 is passed through bore 104 and into pilot hole 108 to attach magnet 106 to lever section 94. Magnet 106 is used to maintain flap 64 against face 54 when desired, as is more fully discussed below.

Disposed between third lever section 94 and bracket 76 is a biasing means. As best shown in FIGS. 4 and 6, the biasing means is an extension spring 112. Spring 112 is used to maintain lever 88 within the selected lever position, as will become more apparent from the following discussion of the operation of the barometric damper assembly 10.

As noted previously, it is desirable in modern buildings to install a barometric damper that can provide a source of fresh air to the building. Such a source of fresh air improves the air quality within the building and can improve the efficiency of combustion appliances.

Figure 7:
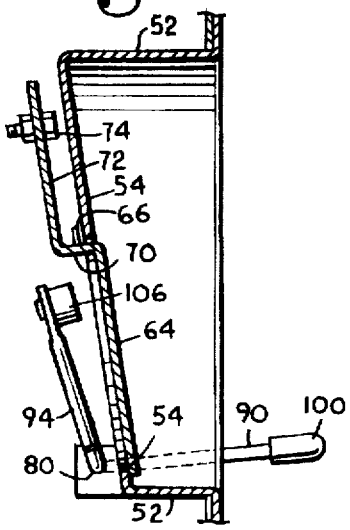
FIG. 7 is a side view of the damper housing taken along line 7—7 of FIG. 3 with the damper lever shown in a position where the damper blade is responsive to barometric pressure.
Figure 8:
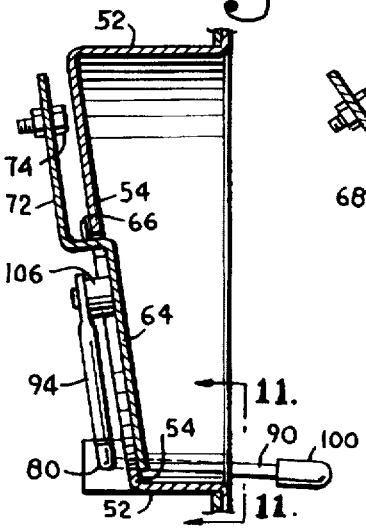
FIG. 8 is a side view similar to FIG. 7 but with the damper lever shown in a position maintaining the damper blade in a closed position.

As best seen in FIGS. 7–9 and 11, lever 88 has three selectable operating positions. Slotted lever opening 96 has three corresponding indentations 114. Lever 88 can be moved into each of indentations 114, allowing the user to select which operating mode of the barometric damper will be employed. When first section 90 of lever 88 is positioned in the uppermost indentation, magnet 106 is maintained away from flap 64, as shown in FIG. 7. When first section 90 is positioned in the middle indentation, magnet 106 is maintained in abutting relationship with flap 64, as shown in FIG. 8. Finally, when first section 90 is positioned in the lower indentation, magnet 106 abuts flap 64 and forces flap 64 into a position away from face 54. The importance of each of these positions is more fully discussed below.

When lever 88 is positioned within the uppermost indentation, magnet 106 is maintained a sufficient distance from flap 64 so that it has no influence over flap 64, as shown in FIG. 7. In this position, flap 64 will move outwardly from face 54 when a sufficient negative pressure exists within the interior of the building. A negative pressure exists when the pressure inside the building is less than the pressure outside the building. When the pressure outside the building is greater than the pressure inside the building, the pressure differential will force flap 64 away from face 54, thus allowing fresh air from outside the building to flow into the building. Flap 64 will remain away from face 54 so long as a sufficient pressure differential exists. The pressure differential necessary to force flap 64 away from face 54 can be adjusted by varying the weight 74 on balance 68. The more that weight 74 is increased, the smaller will be the pressure differential necessary to force flap 64 away from face 54. Therefore, when lever 88 is in the uppermost indentation, flap 64 moves subject to a pressure differential between the interior of the building and the exterior of the building.

When lever 88 is positioned in the middle indentation 114, magnet 106 is maintained in abutting relationship with flap 64, as best shown in FIG. 8. In this position flap 64 is held against face 54 by magnet 106. Therefore, when lever 88 is positioned in the middle indentation, flap 64 is prevented from moving away from face 54. In this mode of operation, flap 64 will not move away from face 54 when a negative pressure exists within the building. This mode of operation thus allows the user to "shut off" the barometric damper. Magnet 106 and lever 88 thus provide a simple, nonmechanical means of maintaining the damper blade in a closed position. The use of magnet 106 provides both an economical and a reliable device to perform this function. No mechanical parts requiring repair or replacement are necessary.

Figure 9:
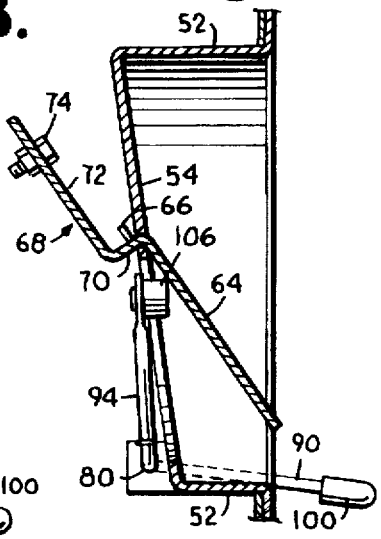
FIG. 9 is a side view similar to FIG. 7 but with the damper lever shown in a position maintaining the damper blade in an open position.

When lever 88 is positioned in the lowermost indentation 114, magnet 106 abuts flap 64 and forces flap 64 away from face 54, as is best shown in FIG. 9. In this position, flap 64 is prevented from abutting face 54, thus maintaining a continuous open passageway through which air can flow. This mode of operation allows the user to force flap 64 into an open position and to maintain the flap in the open position until the lever is moved to a different position.

Lever 88 can be moved from one indentation 114 to another as follows. First section 90 is grasped by the user and is shifted away from the indentation 114 in which first section 90 was housed. Enough force must be used to overcome biasing means 112 to shift lever 88. Once freed from the indentation 114, lever 88 is rotatable either upwardly or downwardly. Lever 88 can then be rotated to a desired new operating position. At this point, the user need only release lever 88, and biasing means 112 will return first section 90 to the selected indentation. The selected operating mode will be maintained until another mode is selected.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention what is claimed is:

1. A barometric damper for a structure having an interior and an exterior, comprising:

a housing adapted to be coupled with the structure, said housing defining an opening that allows spatial communication between the structure interior and the structure exterior;

a damper blade movably coupled with said housing, said blade being movable between an open position wherein the blade accommodates air passage through said opening, and a closed position wherein the flow of air through said opening is substantially precluded; and a lever movably coupled with said housing and having a magnet coupled therewith for contacting said lever with said blade, said lever being movable between a first position wherein said lever accommodates free movement of said blade in response to barometric pressure changes on opposite sides of said blade, and a second position wherein said magnet contacts said blade to hold said blade in its closed position.

2. The damper of claim 1 wherein said lever is capable of being adjusted between three separate positions, said first position and said second position, and a third position wherein said lever maintains said blade in its open position.

3. The damper of claim 1 wherein said lever has a first end and wherein said first end is accessible from the interior of the structure.

4. The damper of claim 1 wherein said housing comprises:

an inner wall plate including a first surface defining a slotted lever aperture, said aperture having a plurality of lever-retaining positions;

said inner wall plate further including a duct extending therefrom, said duct having an annular wall extending perpendicularly from said first surface, said duct further having a second surface disposed at the end of said annular wall distal from said first surface, said second surface defining a passage therethrough; and means associated with said second surface for movably mounting said damper blade to said second surface.

5. The device of claim 4 wherein said slotted opening has at least two lever retaining positions.

6. The device of claim 5 wherein said two lever retaining positions correspond to a blade closed position and a position allowing the blade to move freely as dictated by a pressure difference between the structure interior and the structure exterior.

7. The device of claim 2 further comprising a biasing means for biasing said lever against a selected one of said lever retaining positions.

8. The device of claim 7 wherein said biasing means is a spring.

9. The device of claim 1 wherein said blade has a weight disposed thereon and wherein said weight can be varied, and wherein increasing said weight decreases the force necessary to swing said blade towards the structure interior.

10. The device of claim 1 wherein said blade has a center of gravity and said blade has a weight disposed thereon, and wherein said weight is positionable on said blade, and wherein said center of gravity of said blade can be changed by repositioning said weight on said blade, thus varying the force necessary to swing said blade toward the structure interior.

11. The damper of claim 4 further comprising:

an inner grill attached to said inner wall plate;

a back plate defining a circular passage therethrough; and an outer grill attached to said back plate.

12. The damper of claim 11 wherein said inner wall plate has means disposed thereon for mounting said inner wall plate to an interior wall.

13. The damper of claim 12 wherein said back plate has means disposed thereon for mounting said back plate to an exterior wall.

14. A method of using a barometric damper for a structure that allows communication between a high pressure region and a low pressure region, the damper having an open position, a closed position, and a position wherein a damper blade is freely movable in response to barometric pressure changes on opposite sides of the blade, said method comprising:

selecting an open position for the blade when communication is desired between the high pressure region and the low pressure region;

selecting a closed position for the blade when communication between the high pressure region and the low pressure region is to be prevented; and selecting a position that allows the blade to move freely in response to barometric pressure changes when the damper is desired to operate to equalize the pressure between the high pressure region and the low pressure region.

15. The method of claim 14 wherein selecting said closed position includes:

moving a lever having a magnet disposed thereon into abutting relationship with a damper blade so that said magnet precludes said blade from moving.

16. A barometric damper for a structure comprising:

a housing adapted to be coupled with the structure, said housing defining an opening that allows spatial communication between a high pressure region and a low pressure region;

a damper blade movably coupled with said housing, said blade being movable between an open position wherein the blade accommodates air passage through said opening, and a closed position wherein the flow of air through said opening is substantially precluded; and a lever movably coupled with said housing and having a contacting means for contacting said lever with said blade, said lever being movable between a first position wherein said lever accommodates free movement of said blade in response to barometric pressure changes on opposite sides of said blade, a second position wherein said contacting means contacts said blade to hold said blade in its closed position, and a third position wherein said contacting means holds said blade in its open position.

17. The damper of claim 16 wherein said contacting means is a magnet coupled to said lever.

18. The damper of claim 16 further comprising a weight disposed on said blade which can be varied to vary the force necessary to swing said blade into the open position.

* * * * *